United States Patent [19]

Cunningham

[11] 4,248,689

[45] Feb. 3, 1981

[54] ELECTROLYTIC CELL

[75] Inventor: Hugh Cunningham, Corpus Christi, Tex.

[73] Assignee: PPG Industries, Inc., Pittsburgh, Pa.

[21] Appl. No.: 56,494

[22] Filed: Jul. 11, 1979

[51] Int. Cl.[3] ..... C25B 9/00; C25B 15/08; C25B 13/08; C25B 11/02

[52] U.S. Cl. ..... 204/252; 204/266; 204/283; 204/288; 204/290 R

[58] Field of Search ..... 204/252–258, 204/263–266, 283

[56] References Cited

U.S. PATENT DOCUMENTS

| | | | |
|---|---|---|---|
| 3,344,053 | 9/1967 | Neipert et al. | 204/263 X |
| 4,110,191 | 8/1978 | Specht et al. | 204/263 X |
| 4,136,004 | 1/1979 | Kamarian et al. | 204/256 |
| 4,153,530 | 5/1979 | Vallance et al. | 204/252 |
| 4,175,024 | 11/1979 | Darlington | 204/283 X |

*Primary Examiner*—G. L. Kaplan
*Assistant Examiner*—D. R. Valentine
*Attorney, Agent, or Firm*—Richard M. Goldman

[57] ABSTRACT

Disclosed is an electrolytic cell having a rectangular first tank with a floor and sidewalls, and electrodes extending upwardly therefrom, and being open at at least one end to carry a tank for the electrodes of opposite polarity. The second tank has vertical hollow electrodes extending outwardly therefrom into the first tank, and interleaved between the electrodes extending upwardly from the floor of the first tank. The electrolytic cell is further characterized by the individual hollow electrodes being individually adjustable and removable and bearing an individual permionic membrane thereon.

12 Claims, 11 Drawing Figures

Fig. 1
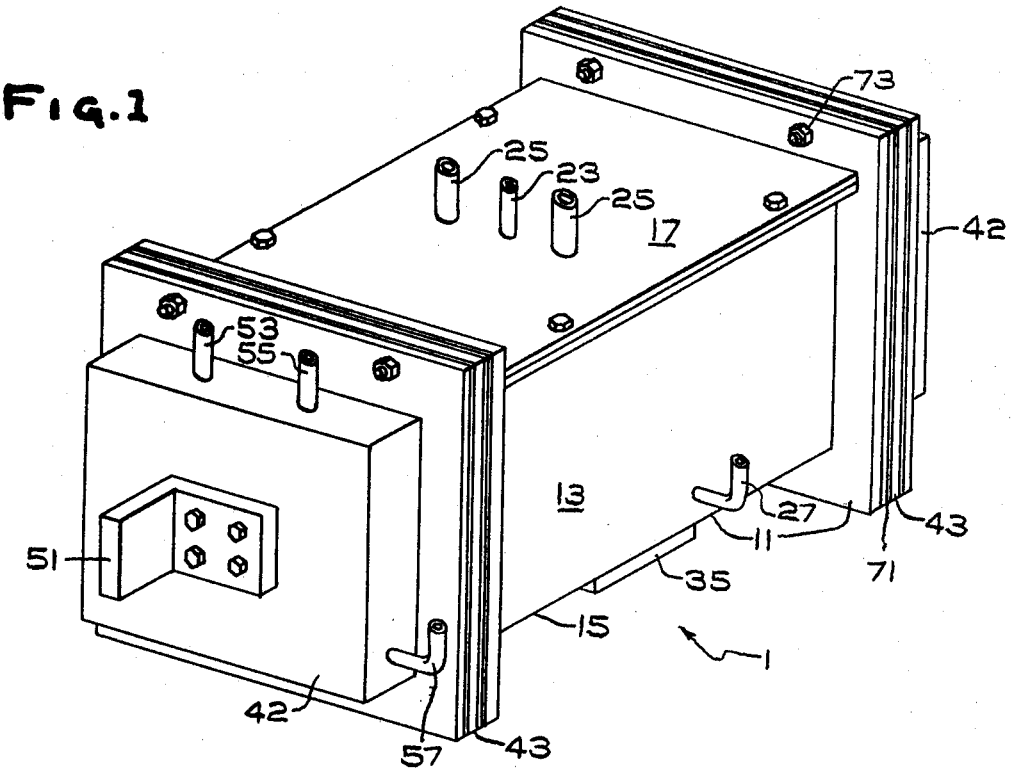
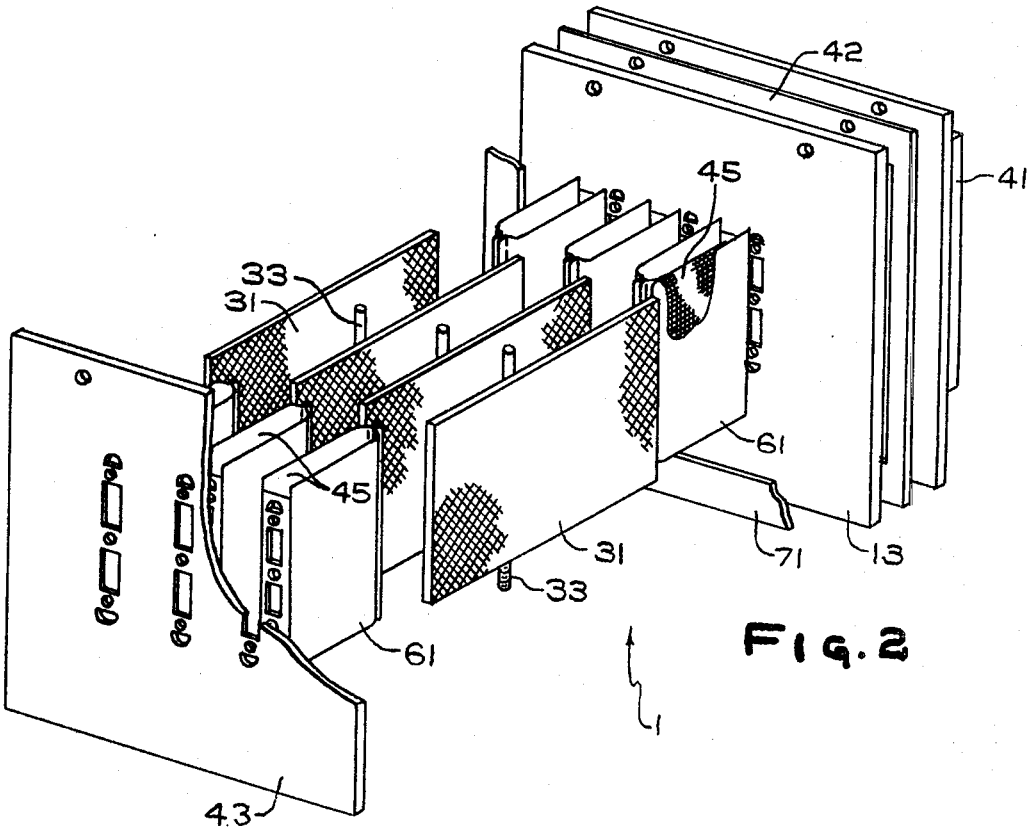
Fig. 2

FIG. 3
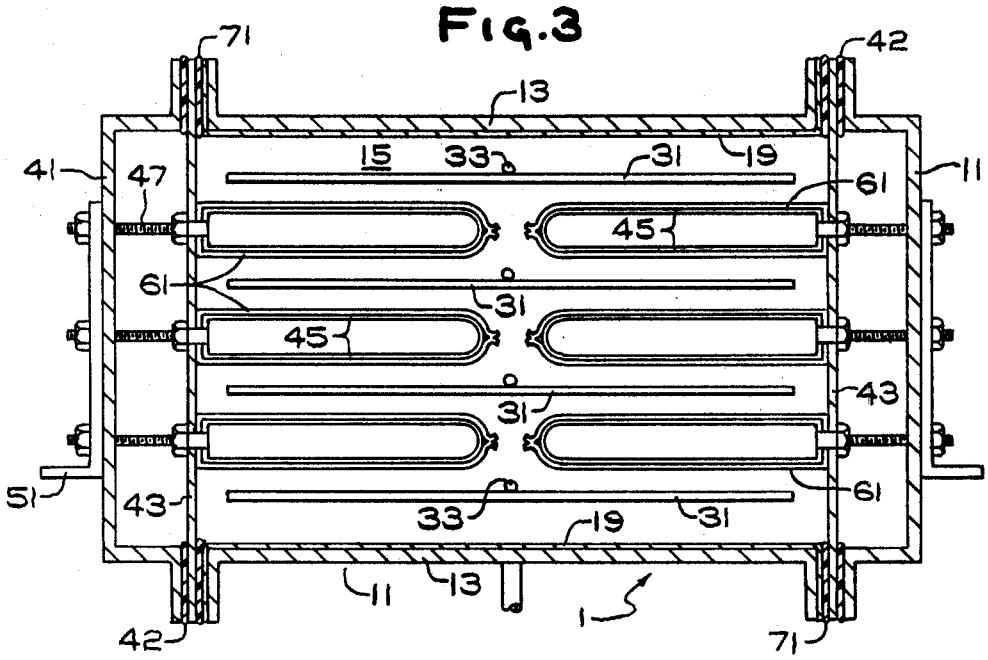
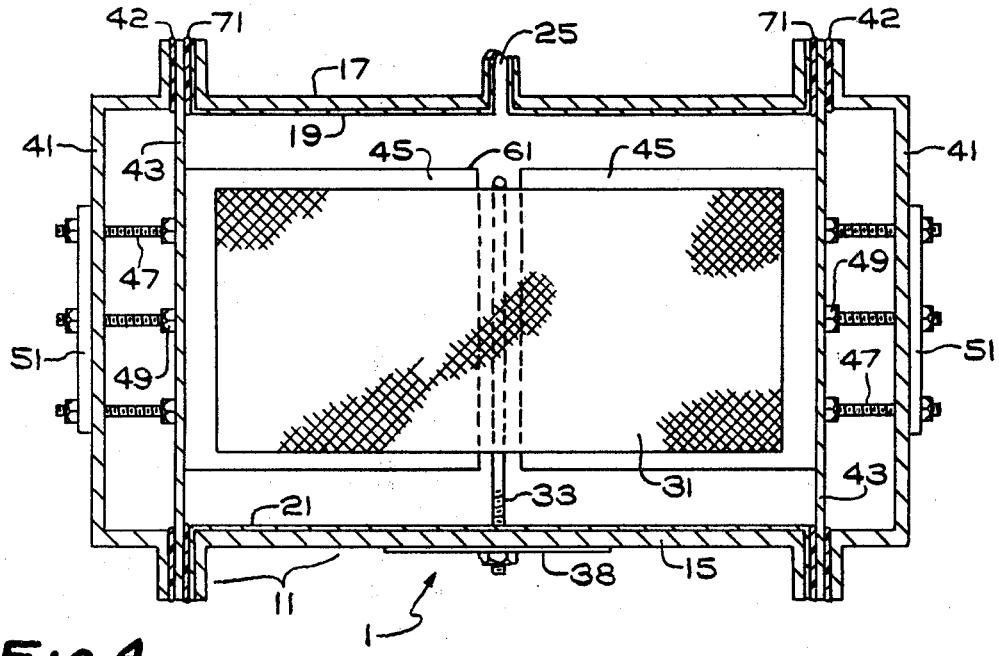
FIG. 4
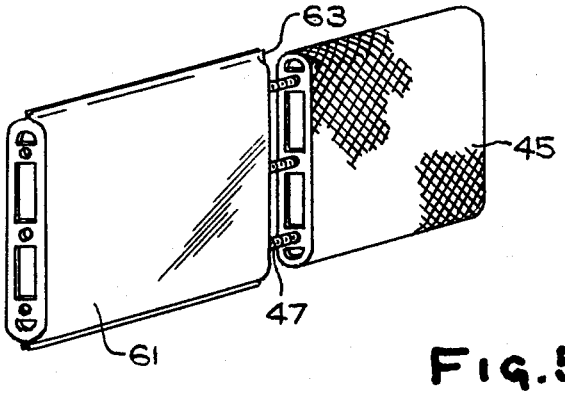
FIG. 5

ELECTROLYTIC CELL

DESCRIPTION OF THE INVENTION

In one commercial process for the electrolysis of alkali metal chlorides to yield chlorine and alkali metal hydroxides, an electrolytic cell having an anolyte compartment separated from a catholyte compartment by an ion permeable separator is utilized. The anolyte compartment has an acidic anolyte containing from about 125 to about 250 grams per liter of sodium chloride or about 106 to about 320 grams per liter of potassium chloride at a pH of from about 2.5 to about 5.5, with chlorine being evolved at the anode. The catholyte compartment has an alkaline catholyte containing at least one mole per liter of alkali metal hydroxide and frequently as much as 12 moles per liter of alkali metal hydroxide, with hydrogen being evolved at the cathode.

The ion permeable separator separates the acidic anolyte from the alkaline catholyte. As herein contemplated, the separator is a synthetic separator, for example, a microporous diaphragm or a permionic membrane. Microporous diaphragms, i.e., microporous flurocarbon sheets or films, allow the chloride ion to diffuse through the separator with the alkali metal ion, providing a cell liquor of alkali metal hydroxide and alkali metal chloride.

Alternatively, the synthetic separator may be a permionic membrane, i.e., a cation selective permionic membrane. Cation selective permionic membranes useful in chlor-alkali electrolysis are flurocarbon resins having cation selective, anion blocking pendent groups thereon. The pendent groups may be acid groups, as carboxylic acid groups, sulfonic acid groups, phosphonic acid groups, phosphoric acid groups, derivatives thereof, and precursors thereof.

For various reasons, the use of synthetic separators such as the fluorocarbon materials described above, is preferred. However, flurocarbon materials useful in forming synthetic separators are difficult to form into shapes necessary for banks of closely spaced electrodes, for example, fingered cathodes or fingered anodes, especially as contrasted with the prior art vacuum deposition of asbestos from an aqueous slurry. The provision of joints, seams, convolutions, seals and the like requires conditions such as high temperatures, strong reagents, high pressures, or combinations thereof. These conditions may have a deleterious effect upon the electrodes bearing the synthetic separator, as where the conditions are encountered after mounting the synthetic separator on or in contact with the electrode. This is because these rigorous sealing or joining conditions may damage the catalytic effect of any coatings on the electrode or any catalytic properties the electrode surface may have. Additionally, the avoidance of complex seaming, sealing, and joining is desirable as an end in itself.

If has now been found that a particularly desirable electrolytic cell having a synthetic separator is one having a generally rectangular electrode tank, e.g., an anode tank, with a plurality of metal electrodes, e.g., anodes, substantially parallel to each other and to the sides of the tank, extending upwardly from the floor of the tank. The preferred electrolytic cell further includes a unit, e.g., a wall tank, at one end of the tank having its own tank for containment of the opposite electrolyte, e.g., a catholyte tank, a vertical support plate between the smaller tank and the larger tank for bearing the electrodes of opposite polarity, e.g., the cathodes, and a plurality of individual generally rectangular, hollow, electrode elements of opposite polarity, e.g., cathodes, extending substantially perpendicularly outward from the vertical support plate, the electrodes being parallel to the first-mentioned electrodes, e.g., the anodes, extending upwardly from the floor of the electrode tank.

As herein contemplated, each of the individual electrode elements extending outwardly from the wall tank are in full communication with the wall tank and with each other through the wall tank. Additionally, each of the individual hollow electrode elements are individually removable and have a polymeric synthetic separator. The polymeric synthetic separator surrounding each individual hollow electrode element is a single sheet enveloping the individual electrode element, having a perforate portion compressively interposed between one edge of the individual electrode element and the vertical electrode support plate, and sealed along the other edges, that is, edges remote from the vertical electrode support plate. The individual hollow electrode elements compressively bear upon the vertical electrode support plate with a membrane therebetween, whereby to provide an electrolyte tight seal and prevent mixing of the two electrolytes, i.e., the anolyte and the catholyte.

THE FIGURES

FIG. 1 is an isometric view of an electrolytic cell utilizing the cell structure of this invention.

FIG. 2 is an exploded isometric view of the internal components of the electrolytic cell shown in FIG. 1.

FIG. 3 is a cutaway plan view of the electrolytic cell shown in FIG. 1.

FIG. 4 is a cutaway side elevation of the electrolytic cell shown in FIGS. 1, 2 and 3.

FIG. 5 is an electrode element of the electrolytic cell shown in FIGS. 1–4.

DETAILED DESCRIPTION OF THE INVENTION

Figure 6:
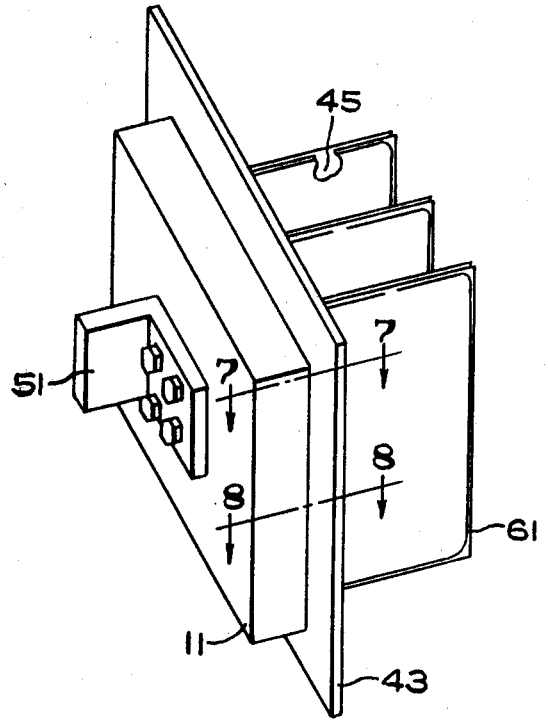
FIG. 6 is an electrode element of te electrolytic cell shown in FIGS. 1–5.
Figure 7:
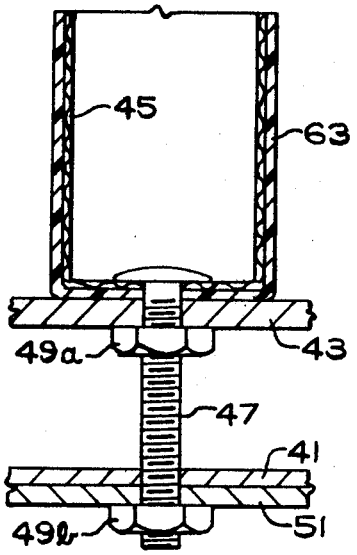
FIG. 7 is a partial cutaway view along cutting plane 7—7 of the electrode element shown in FIG. 6.
Figure 8:
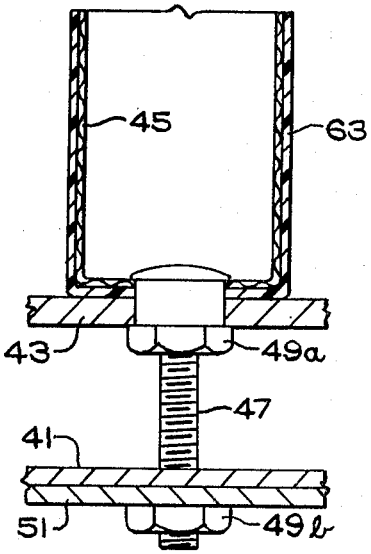
FIG. 8 is a partial cutaway plan view of the electrolytic cell element shown in FIG. 6 along cutting plane 8—8.

The electrolytic cell 1 herein contemplated has a substantially rectangular cell box 11 having sides 13, bottom 15, a top 17 and endwalls 18. In a preferred exemplification where the cell box 11 is an anode box, the sides, bottom and top are fabricated of an anolyte-resistant material. That is, the sides 13, bottom 15 and top 17 are fabricated of a material that is resistant to chlorinated alkali metal chloride brines at a high concentration. The materials of construction may be valve metals. By valve metals are meant those metals which form an oxide film upon exposure to acidified alkali metal chloride solutions under anodic conditions. The valve metals include titanium, tantalum, tungsten, columbium, zirconium and alloys thereof. Alternatively, the rectangular anode box 11 may be fabricated of a material that is not of especial resistance to aqueous acidified brine anolytes but that has a lining 19 on the sides 13 and top 17 and bottom 15 that is resistant to the aqueous acidified brine anolyte solutions. Such a lining may be a liner, layer, film, sheet, or coating of a polymeric material, e.g., fluorocarbon resin, or of a valve metal.

The rectangular anode 11 box also includes brine feed means 23 and chlorine recovery means 25 in the top 17 and depleted brine recovery 27 in either the sides 13 or bottom 15.

The anodes 31 are in the form of coated metal substrates. The substrate is a valve metal, as described hereinabove, most frequently tantalum or titanium, and preferably titanium. The valve metal substrate has an electrocatalytic chlorine evolution catalyst thereon, as is well known in the art, e.g., a platinum group metal, a compound of a platinum group metal, a transition metal, a compound of a transition metal, or another chlorine liberating catalyst.

The anode blades 31 may be in the form of imperforate sheets or plates, perforate sheets or plates, expanded metal mesh, metal mesh, or the like. The individual blades 31 are substantially parallel to each other, substantially parallel to the sidewalls 31, and substantially perpendicular to the cell bottom 15 and to the endwalls 18.

Current is supplied to the anodes 31 through risers 33 extending upwardly from a bus bar 35 at the bottom 15 of the anode box 11.

The electrolytic cell 1 herein contemplated may have either one or two cathode units 41. A single cathode unit is at one end, 18, of the anode tank. Alternatively there may be two cathode units at opposite ends 18 of the anode tank 11. Separate individual cathode fingers 45 extend outwardly through the cathode unit 41, for example, from the cathode unit 41 to about halfway across the anode box 11, or substantially all the way across the anode box 11, or even to the opposite box 41.

In a preferred exemplification the cathode box 41, on one end 18 of the anode box 11 or, alternatively, the two cathode boxes 41 on opposite ends 18,18 of the anode box 11 are fabricated of a ctholyte resistant material. By a catholyte resistant material is meant a material that resists the corrosive effects of alkali metal hydroxides in high concentrations, for example, above about 20 weight percent, at elevated temperatures. Such materials include iron, steel, mild steel, stainless steel, cobalt, nickel and the like.

The cathode unit further includes a vertical cathode support plate 43 between the cathode tank 41 and the anode tank 11. The cathode support plate 43 may be fabricated of the catholyte resistant metals described above, for example, iron, steel, mild steel, stainless steel or the like. Alternatively, the cathode support plate 43 may be fabricated of a sturdy catholyte resistant material, for example, a reinforced flurocarbon plate. The vertical cathode support plate 43 may be permeable to electrolyte, in which case it should preferably be fabricated of an electrically conductive metal and have a synthetic separator 61 thereon. Alternatively, the vertical cathode support plate 43 may be impermeable to the electrolyte, in which case it is not necessary that the cathode support plate 63 bear a synthetic separator 61.

The individual hollow cathode elements 45 extend substantially perpendicularly outward from the cathode support plate 43, being parallel to the anode tank sidewalls 13 and to the anode blades 31. The individual hollow cathode elements 45 each have a top, a bottom, two active opposite surfaces, a leading edge, and an open trailing edge, as will be described more fully hereinbelow. The individual hollow cathode elements 45 are interleaved between anode blades 31.

Fluid communication is provided between the cathode tank 41 and the individual hollow cathode fingers 45 and between the individual hollow cathode fingers 45 through the cathode tank 41. The cathode tank 41 includes water feed 53, hydrogen recovery 55 and alkali metal hydroxide recovery 57.

The individually removable hollow cathode fingers 45 include bolts 47 and nuts **49*a* and 49*b*, nuts 49*a* securing the cathode fingers 45 to the vertical cathode support plate 43, while nuts 49*b* secure the individual cathode fingers 45 to the cathode tank 41 and bus bar 51. In this way, electrical connection is provided between the bus bar 51 and the individual cathode finger 45**.

Each of the individual cathode elements 45 has a polymeric, ion permeable, synthetic separator 61 thereon. The synthetic separator 61 is a single sheet enveloping the individual cathode element 45, as seen in special detail in FIG. 5. As there shown, the separator has a perforate portion **61*a* compressively interposed between the edge 45*a* of the cathode element 45 bearing upon the cathode support plate 43. The synthetic separator 61 is sealed along the other edges 65*a*, 65*b* and 65*c*, i.e., the edges remote from the base 45*a* of the cathode element 45**.

The individual cathode elements 45 bear upon the cathode support plate 43 with the membrane 61 therebetween whereby to provide an electrolyte-tight catholyte compartment.

Additionally, a resilient material may be provided on the cathode support plate 43 whereby to provide further electrolyte tight seal.

The anode tank 11 and cathode tank 41 with its cathode elements 45 sealed together, for example, with gaskets 71 between the anode box 11 and cathode support plate 43, and with gasket 42 between the cathode support plate 43 and the cathode box 41, provides an electrolyte tight electrolytic cell.

In the operation of the electrolytic cell herein contemplated, brine is fed into the anode box 11 through brine feed 23 which may extend to the lower half of the anode box 11, and an electrical potential is imposed across the electrolytic cell from anode bus bar 35 to cathode bus bar 51. The electrical potential causes current to flow from a power supply to the anodic bus bar 35 and from the anodic bus bar 35 to and through the electrolytic cell to the cathodic bus bar 51.

The brine feed is a saturated brine typically containing from about 300 to about 325 grams per liter of sodium chloride or from about 400 to about 450 grams per liter of potassium chloride. The brine in the cell typically contains from about 125 to about 250 grams per liter of sodium chloride or from about 160 to about 320 grams per liter of potassium chloride. The catholyte liquid product generally contains from about 100 to about 225 grams per liter of sodium chloride and from about 110 to about 150 grams per liter of sodium hydroxide when the synthetic separator 61 is a microporous diaphragm. Alternatively, the cell liquor recovered through the cell liquor recovery means 57 is substantially free of alkali metal chloride and consists essentially of an aqueous alkali metal hydroxide solution containing in excess of about 40 weight percent sodium hydroxide or in excess of about 52 weight percent potassium hydroxide where the synthetic separator 61 is a permionic membrane.

Figure 9:
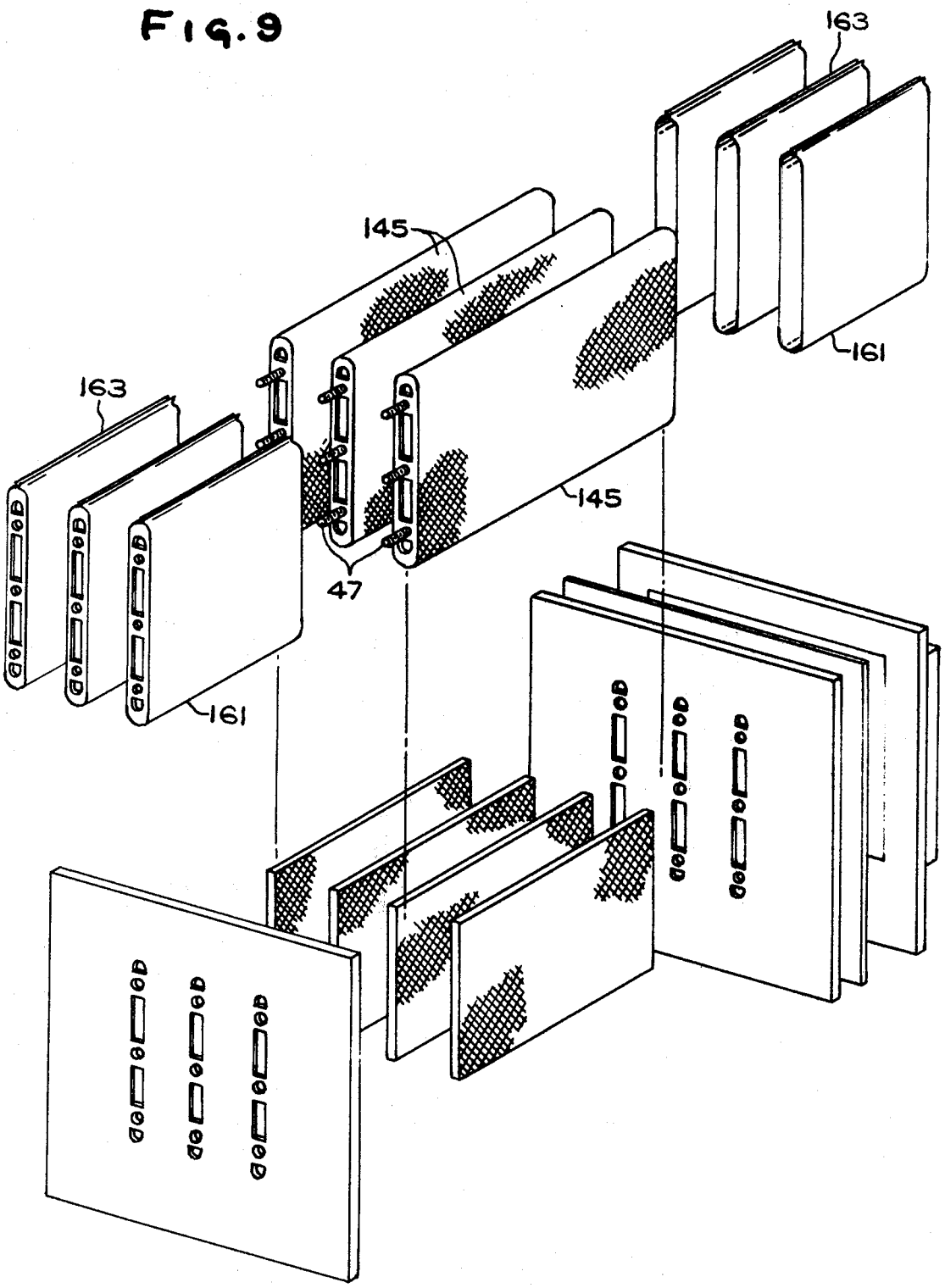
FIG. 9 is a partially exploded isometric view of an alternative exemplification of the electrolytic cell of this invention.
Figure 10:
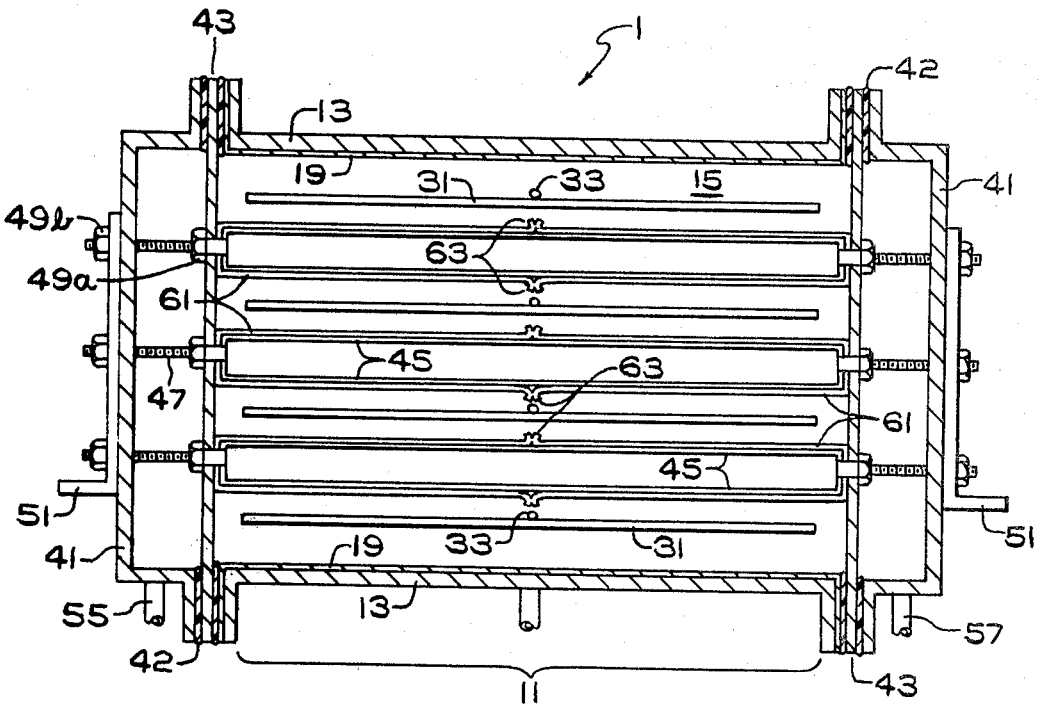
FIG. 10 is a cutaway plan view of the electrolytic cell shown in isometric exploded view of FIG. 9.
Figure 11:
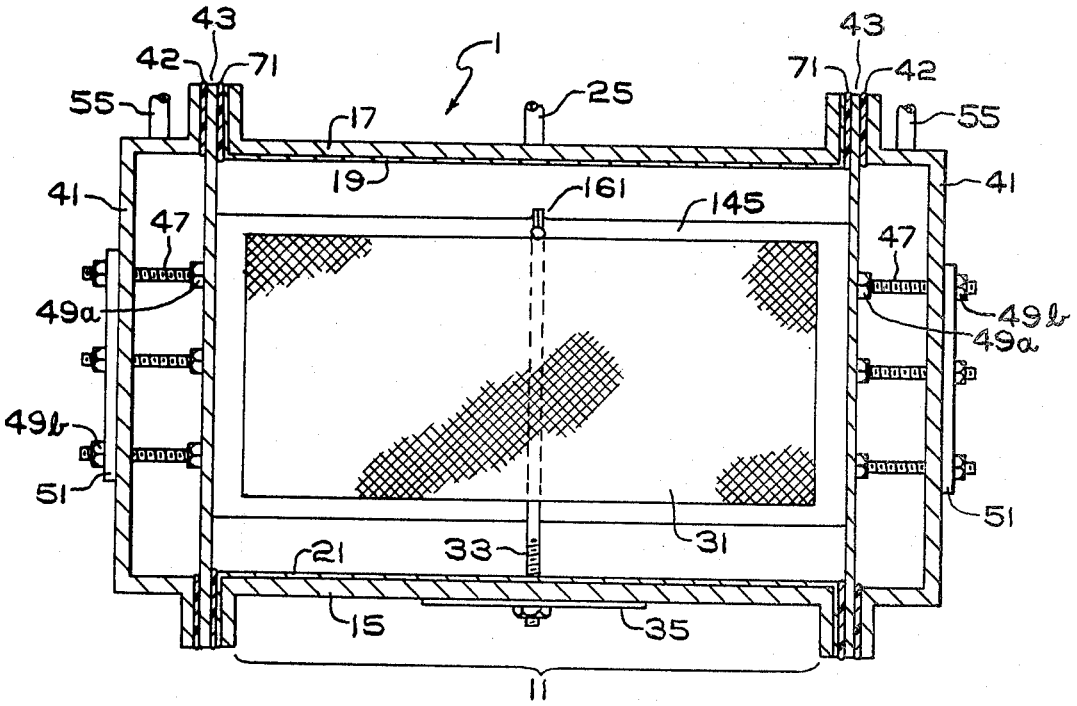
FIG. 11 is a cutaway side elevation of the electrolytic cell shown in FIGS. 9 and 10.

According to an alternative exemplification of this invention, shown with particular detail in FIGS. 9, 10 and 11, the cathode fingers 145 extend from one cathode box 41 to the opposite cathode box 41 and have a permionic membrane 161 extending from one cathode box 41 to the opposite box 41, with extended joints 163 extending from cathode box 41 to cathode box 41.

While the invention has been described with reference to certain specific and illustrated embodiments, it is not intended to be so limited except insofar as it appears in the accompanying claims. For example, the electrolytic cell herein contemplated may be of opposite construction to that described above and shown in the illustrations, wherein the permionic membrane bears upon hollow anodes extending outwardly from an anolyte tank and the cathodes are upwardly extending from the bottom of the cell. Such an electrolytic cell is characterized by a rectangular cathode tank having a floor, and sidewalls, and being open at at least one end. The electrolytic cell of the alternative exemplification herein described includes a plurality of cathode blades, substantially parallel to each other and to the cathode tank, sidewalls, and extending upwardly from the cathode tank floor. An anode unit is at one end of the cathode tank. Alternatively, the anode units are at opposite ends of the cathode tank. The individual anode units include an anode tank, a vertical anode support plate between the anode tank and the cathode tank, and a plurality of individual, rectangular, hollow anode elements extending perpendicularly outwardly from the vertical anode support plate, parallel to the cathode tank sidewalls and the cathode blades, and interleaved between the cathode blades. Each of the individual anode elements are in fluid communication with the anode tank and with each other through the anode tank and each of the individual anode elements are individually removable. As herein contemplated, each of the individual anode elements bears a polymeric synthetic separator, for example, a permionic separator, the separator being a single sheet enveloping each individual anode element and having a perforated portion compressively interposed between one edge of the anode element and the vertical anode support plate, and sealed along the other edges of the anode element. Each of the individual anode elements compressively bears upon the vertical anode support plate with a membrane therebetween whereby to provide an electrolyte tight seal.

According to a still further alternative exemplification, a spacer means or example, nets, fins, electrically insulated fins, fluorocarbon or asbestos rope or string or the like may be interposed between an electrode bearing a synthetic separator 61 and the synthetic separator 61 whereby to provide space between the electrode 45 and the separator 61 and to position the separator 61 closer to the electrode 31 of opposite polarity. Preferably, when the spacing is provided by a fluorocarbon rope or string or an asbestos rope or string, the individual strands are substantially vertical, on a pitch of from about 0.25 inch to about 1.50 inches, and have a diameter of from about 0.05 to about 0.25 inch, whereby to allow the upward flow of gases and electrolyte between the electrode and separator. Such ropes or strings are substantially free of horizontal strands, or have horizontal strands or elements of smaller diameter than the vertical strands, e.g., less than about one-quarter of the diameter of the vertical strands, whereby to avoid impeding the upward flow of the gases. A spacer as described above is referred to as being vertically oriented.

While the invention has been described with respect to certain exemplifications and embodiments thereof, the inventive concept is not to be so limited except as in the claims appended thereto.

What is claimed is:

1. An electrolytic cell comprising:

(a) a rectangular anode tank having a floor, top, and sidewalls, and being open at opposite ends thereof;

(b) a plurality of coated metal anode blades substantially parallel to each other and to the anode tank sidewalls, extending upwardly from the anode tank floor;

(c) a cathode unit at each of the opposite open ends of said anode tank, each of said cathode units comprising (1) a cathode tank, (2) a vertical cathode support plate between the cathode tank and the anode tank, and (3) a plurality of individual hollow cathode elements extending perpendicularly outwardly from said cathode support plate, parallel to said anode tank sidewalls and said anode blades, and interleaved between said anode blades;

(d) each of said individual cathode elements being in fluid communication with said cathode tank and with each other through said cathode tank;

(e) each of said individual cathode elements being individually removable;

(f) each of said individual cathode elements bearing a polymeric synthetic separator, said separator (1) being a single sheet enveloping said individual cathode element, (2) having a perforate portion compressively interposed between said one edge of said cathode element and said cathode support plate, and (3) sealed along the other edges of said cathode element; and (g) said individual cathode elements compressively bear upon said cathode support plate with said membrane therebetween whereby to provide an electrolyte-tight seal.

2. The electrolytic cell of claim 1 wherein said cathode support plate has a resilient, non-conductive surface thereon.

3. The electrolytic cell of claim 1 wherein individually removable cathodes extend from each of said cathode units.

4. The electrolytic cell of claim 1 wherein individually removable cathodes extend from one of said cathode units to the opposite cathode unit.

5. An electrolytic cell comprising:

(a) a rectangular cathode tank having a floor, top, and sidewalls, and being open at opposite ends thereof;

(b) a plurality of cathode blades substantially parallel to each other and to the cathode tank sidewalls, extending outwardly from the cathode tank floor;

(c) an anode unit at each of the opposite open ends of said cathode tank, each of said anode units comprising (1) an anode tank, (2) a vertical anode support plate between the anode tank and the cathode tank, and (3) a plurality of individual hollow anode elements extending perpendicularly outwardly from said anode support plate, parallel to said cathode tank sidewalls and said cathode blades, and interleaved between said cathode blades;

(d) each of said individual anode elements being in fluid communication with said anode tank and with each other through said anode tank;

(e) each of said individual anode elements being individually removable;

(f) each of said individual anode elements bearing a polymeric synthetic separator, said separator (1) being a single sheet enveloping said individual anode element, (2) having a perforate portion compressively interposed between said one edge of said anode element and said anode support plate, and (3) sealed along the other edges of said anode element; and (g) said individual anode elements compressively bear upon said anode support plate with said membrane therebetween whereby to provide an electrolyte-tight seal.

6. The electrolytic cell of claim 5 wherein said anode support plate has a resilient, non-conductive surface thereon.

7. The electrolytic cell of claim 5 wherein individually removable anodes extend from each of said anode units.

8. The electrolytic cell of claim 5 wherein individually removable anodes extend from one of said anode units to the opposite anode unit.

9. An electrolytic cell comprising:

(a) a rectangular first tank having a floor, top, and sidewalls, and being open at opposite ends thereof;

(b) a plurality of electrode blades substantially parallel to each other and to the tank sidewalls, extending upwardly from the tank floor:

(c) an electrode unit at each of the opposite open ends of said tank, each of said electrode units comprising (1) a second tank, (2) a vertical electrode support plate between the second tank and the first tank, and (3) a plurality of individual hollow electrode elements of opposite polarity to the electrode blades extending perpendicularly outwardly from said electrode blades, and interleaved between said electrode blades;

(d) each of said individual hollow electrode elements being in fluid communication with said second tank and with each other through said second tank;

(e) each of said individual hollow electrode elements being individually removable;

(f) each of said individual hollow electrode elements bearing a polymeric synthetic separator, said separator (1) being a single sheet enveloping said individual hollow electrode element, (2) having a perforate portion compressively interposed between said one edge of said hollow electrode element and said electrode support plate, and (3) sealed along the other edges of said hollow electrode element; and (g) said individual hollow electrode elements compressively bear upon said electrode support plate with said membrane therebetween whereby to provide an electrolyte-tight seal.

10. The electrolytic cell of claim 9 wherein said electrode support plate has a resilient, non-conductive surface thereon.

11. The electrolytic cell of claim 9 wherein individually removable hollow electrodes extend from each of said electrode units.

12. The electrolytic cell of claim 9 wherein individually removable hollow electrodes extend from one of said electrode units to the opposite electrode unit.

* * * * *

UNITED STATES PATENT AND TRADEMARK OFFICE

CERTIFICATE OF CORRECTION

PATENT NO. : 4,248,689

DATED : February 3, 1981

INVENTOR(S) : Hugh Cunningham

It is certified that error appears in the above-identified patent and that said Letters Patent are hereby corrected as shown below:

Column 6, line 59, "outwardly" should read --upwardly--.

Signed and Sealed this

First Day of September 1981

[SEAL]

*Attest:*

GERALD J. MOSSINGHOFF

*Attesting Officer*

*Commissioner of Patents and Trademarks*